United States Patent [19]

Notaro et al.

[11] 4,300,356

[45] Nov. 17, 1981

[54] REFRIGERATION STORAGE ASSEMBLY

[75] Inventors: Frank Notaro, Amherst; Arun Acharya, East Amherst; Kenneth C. Kather, Kenmore, all of N.Y.

[73] Assignee: Union Carbide Corporation, New York, N.Y.

[21] Appl. No.: 96,408

[22] Filed: Nov. 21, 1979

[51] Int. Cl.[3] ..... F17C 7/02

[52] U.S. Cl. ..... 62/50; 62/457; 62/514 R

[58] Field of Search ..... 62/45, 457, 514 R, 50

[56] References Cited

U.S. PATENT DOCUMENTS

| | | | |
|---|---|---|---|
| 1,898,977 | 2/1933 | Comstock | 220/9 |
| 2,000,882 | 5/1935 | Comstock | 220/9 |
| 2,550,040 | 4/1951 | Clar | 312/214 |
| 2,617,551 | 11/1952 | Hopkins | 220/9 |
| 3,005,317 | 10/1961 | Bunn | 62/45 |
| 3,130,561 | 4/1964 | Hnilicka, Jr. | 62/45 |
| 3,133,422 | 5/1964 | Paivanas et al. | 62/45 |
| 3,166,913 | 1/1965 | Carter | 62/45 |
| 3,605,431 | 9/1971 | Carson | 62/457 |
| 3,789,616 | 2/1974 | Davidge | 62/514 R |
| 3,823,567 | 7/1974 | Corini | 62/3 |
| 3,930,375 | 1/1976 | Hofmann | 62/45 |

OTHER PUBLICATIONS

Hilal et al. "Cryogenic Design for Large Superconductive Storage Magnets" *Advances in Cryogenic Ener.* vol. 21, 1975.

Eyssa et al. "Thermodynamic Optimization of Thermal Radiation Shields for a Cryogenic Apparatus", *Cryogenics*, May 1978, pp. 305–308.

*Primary Examiner*—Ronald C. Capossela

*Attorney, Agent, or Firm*—John J. Kelly, Jr.

[57] ABSTRACT

A refrigeration storage assembly for the storage of biological materials and the like wherein a higher temperature mechanical refrigeration source and a very low temperature cyrogenic liquid refrigeration source coact to maintain an intermediate low storage temperature.

19 Claims, 6 Drawing Figures

REFRIGERATION STORAGE ASSEMBLY

This invention relates to a refrigeration storage assembly for the storage of biological materials and the like at low temperatures. More particularly, the invention relates to a hybrid refrigeration storage assemble for the storage of biological materials and the like at low temperatures wherein a very low temperature cryogenic liquid refrigeration source and a higher temperature mechanical refrigeration source coact in a manner to maintain the intermediate low storage temperature.

BACKGROUND OF THE INVENTION

Commercial and research laboratories have the need for the long term storage of biological materials such as blood, bone, tissue samples and biological cultures. The long term storage of such biological materials requires a temperature typically lower than about 150° K. Although such biological materials are often stored at temperatures as low as that of, e.g., liquid nitrogen (77° K), temperatures of about 140°±10° K. are generally suitable for such long term storage requirements.

State of the art mechanical refrigeration units can develop effective, low cost refrigeration to only about a 190° K. temperature level for two stage mechanical refrigeration units and about a 170° K. temperature level for three stage mechanical refrigeration units. Although multistage mechanical refrigeration units are capable of supplying refrigeration at a level of about 140° K., such units are complex and expensive and therefore often undesirable for such routine storage requirements.

Refrigeration units commonly used for the storage of biological materials employ the use of a cryogenic liquid, most particularly liquid nitrogen, as the refrigeration source. Such state of the art liquid nitrogen refrigeration units typically comprise an insulated storage container holding a quantity of liquid nitrogen in the bottom of the storage area and have a shelf positioned above the liquid nitrogen level on which shelf the biological materials are stored. Such a container includes a lid in the top of the container for providing access for the insertion or removal of the biological materials. Refrigeration is provided by the evaporation of liquid nitrogen. It is apparent that such a refrigerated storage container has the disadvantage that expensive liquid nitrogen at a temperature of 77° K. must be evaporated to provide the sole refrigeration source in an application where a storage temperature of only about 140° K. is typically required.

Such state of the art liquid nitrogen refrigeration units have the further disadvantage in that opening the lid of the container for either insertion or removal of the biological materials significantly increases the evaporation and hence loss of the expensive liquid nitrogen refrigeration source. Such insertions or removals of the biological materials can be a common occurrence in commerical or research laboratories employing biological materials.

OBJECT OF THE INVENTION

It is therefore an object of the present invention to provide an improved refrigeration storage assembly for the storage of biological materials and the like.

It is a further object of the present invention to provide an improved refrigeration storage assembly for the storage of biological materials and the like wherein a very low temperature cryogenic liquid refrigeration source and a higher temperature mechanical refrigeration source coact in a manner to maintain a desired intermediate low storage temperature.

It is a further object of the present invention to provide an improved refrigeration storage assembly for the storage of biological materials and the like at temperatures lower than about 150° K. wherein improved refrigeration efficiency is obtained in service applications requiring frequent access to the refrigerated storage volume.

It is a further object of the present invention to provide an improved refrigeration storage assembly for the storage of biological materials and the like at temperatures lower than about 150° K. wherein the refrigerated storage volume is maintained at an essentially uniform temperature throughout substantially the entire storage volume.

More particularly, it is an object of the present invention to provide an improved refrigeration storage assembly for the storage of biological materials and the like at a temperature lower than about 150° K. wherein a low cost higher temperature mechanical refrigeration source intercepts heat flowing from ambient to the refrigerated storage volume and rejects the heat back to the ambient and a very low temperature cryogenic liquid refrigeration source is evaporated to attain the desired intermediate low temperature wherein coaction of the higher temperature low cost mechanical refrigeration source and the very low temperature cryogenic liquid refrigeration source provides the desired intermediate low storage temperature in a cost effective manner while providing essentially a uniform temperature throughout substantially the entire storage volume and improved performance for service applications requiring frequent access to the storage volume.

These and other objects will be apparent from the following description and claims in conjunction with the drawings.

SUMMARY OF THE INVENTION

The present invention is generally characterized as a refrigeration storage assembly for storing biological materials and the like which comprises:

(A) a storage container comprising:

(i) an inner shell forming an enclosed volume having means for providing access to the enclosed volume;

(ii) an outer shell substantially coextensive with and spaced from the inner shell arranged and constructed with respect to the inner shell so as to form an evacuable space therebetween;

(iii) insulation material disposed within the evacuable space;

(iv) a high thermally conductive shield disposed in the insulation material generally coextensive with and transversely spaced from the inner shell and the outer shell wherein the ratio of the distance from the shield to the outer shell $D_o$ to the distance from the shield to the inner shell Di is from about 1:10 to 1:1;

(B) means for cooling the shield to temperature about 160° K. to 200° K. including:

(i) mechanical refrigeration means external to the storage container (A);

(C) a vessel located within the storage container (A) for holding a cryogenic liquid having a boiling point below 90° K. at one standard atmosphere being arranged and constructed for restricted vapor flow communication with the inner shell enclosed volume (A) (i);

(D) means for evaporating cryogenic liquid in the vessel (C) to form vapor for flow into the inner shell enclosed volume (A) (i) in an amount sufficient to maintain the temperature of the inner shell enclosed volume (A) (i) intermediate to the temperature of the cryogenic liquid and the temperature of the shield (A) (iv).

DESCRIPTION OF THE PREFERRED EMBODIMENTS

Figure 1:
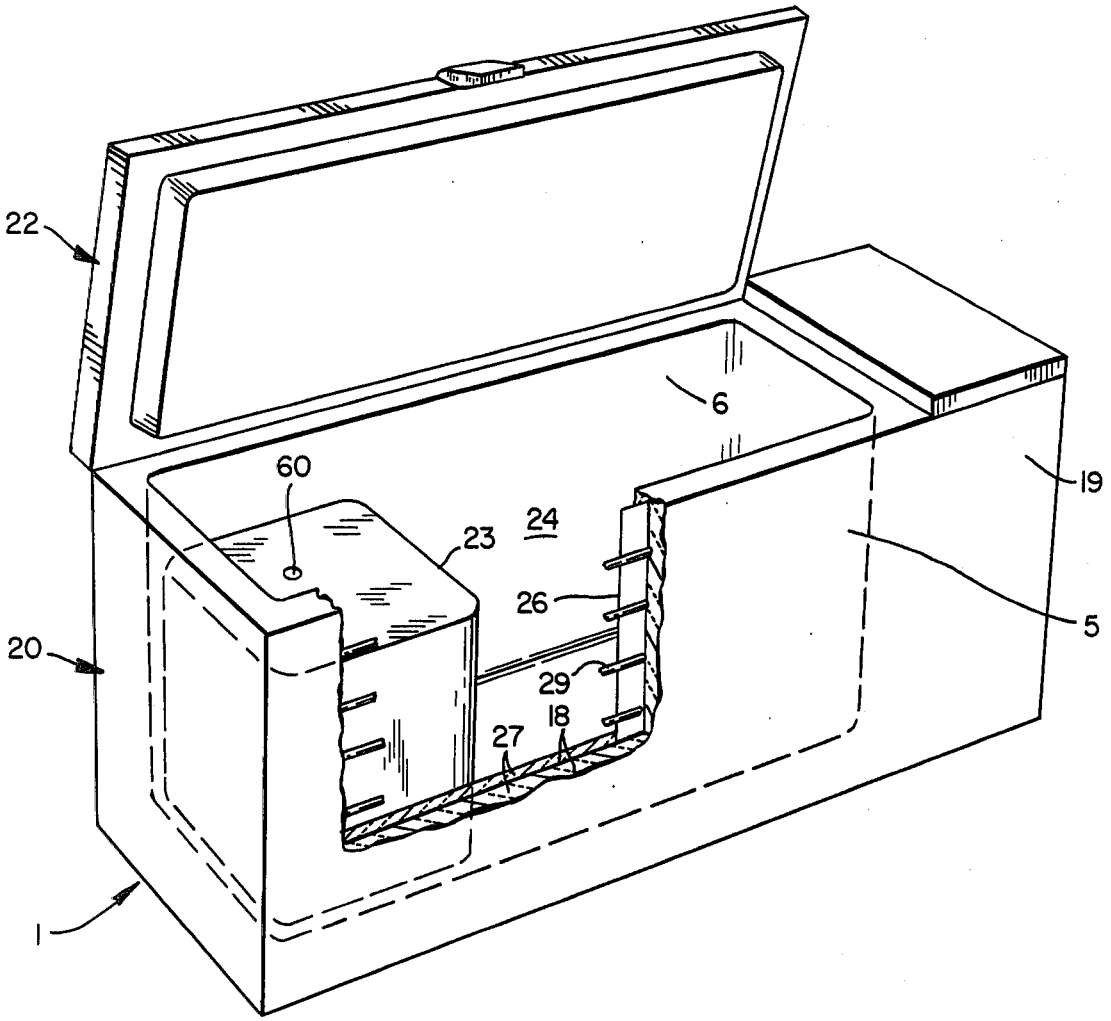
FIG. 1 is a general arrangement of a particular embodiment of a refrigeration storage assembly in accordance with the present invention.

In order to afford a complete understanding of the present invention and an appreciation of its advantages, a description of the preferred embodiments is presented below.

The refrigerated storage assembly of the present invention comprises a double-walled container for the storage of biological materials and the like being constructed from an inner shell forming an enclosed volume and an outer shell substantially coextensive with and spaced from the inner shell arranged and constructed with respect to the inner shell so as to form an evacuable therebetween. The container suitably has the general shape of a right rectangular parallelepiped wherein the access opening is located in the top base. However, as will be apparent to one skilled in the art, the container may be constructed in a variety of flat walled or curved walled geometric shapes. A lid, preferably of insulated construction, is provided for insertion into the access opening when access to the enclosed volume is not required.

Thermal insulation material is disposed within the evacuable space. This insulation material may be in general any thermal insulation known to the art that is suitable for use in evacuated spaces in low temperature applications.

Examples of suitable insulation would include:

Low density fiberglass mats with parallel orientation of the fiber with the mat being mechanically compressed during assembly. An example would be Strathmore Grade 1-110 mat manufactured by Strathmore Paper Division of Hammermill Paper Co., Westfield, Ma.

Molded fiberglass boards manufactured from fiberglass mat having about a 5% to 25% phenolic resin binder with a board density of 10 to 16 lb./cu.ft. (160 to 256 kg/cu.m.). Suitable mats are for example, Johns Mansville No. 4362-60 manufactured by Johns Mansville, Denver, Colorado, and Owens-Corning No. S-22 manufactured by Owens-Corning, Toledo, Ohio. Board suppliers are, for example, Insul Coustic Corp., Sayerville, N.J. and Sono Therm Corp., Buffalo, N.Y.

In accordance with the present invention, a highly thermally conductive member is disposed within and is surrounded by the insulation material. This high thermally conductive member will be referred to hereinafter as a heat shield.

Although contiguous contact between the heat shield and the insulation material is not required, such contact substantially results as a consequence of the vacuum drawn in the evacuable space.

In accordance with the present invention, as hereinafter more fully described, the heat shield intercepts heat flowing from the ambient adjacent to the outer shell of the container towards the enclosed volume which heat is then rejected back to the ambient. Thus the amount heat flowing from the ambient into the enclosed volume will be decreased from the amount of heat flowing into the enclosed volume absent the heat shield.

The high thermally conductive heat shield is suitably generally coextensive with and transversely spaced from the inner shell and outer shell of the container. The heat shield is positioned so that the ratio of the distance from the shield to the outer shell, $D_o$, to the distance from the shield to the inner shell, Di, is about 1:10 to 1:1. Preferably, the ratio of the distance $D_o$ to Di is about 1:5 to 1:3.

The heat shield is suitably positioned so that the distance from the shield to the outer shell, $D_o$, is about ½ to 2 inches (1.27 to 5.08 cm). Most suitably the distance $D_o$ is about 1 inch (2.54 cm).

The heat shield of the present invention is suitably fabricated from a sheet of high thermally conductive metal having a thermal conductivity of at least about 0.6 watt/cm° K. at 190° K. and preferably at least about 1.5 watt/cm° K. Suitable metals for the fabrication of the heat shield include aluminum, copper, carbon steel and brass.

Aluminum would be advantageous for commercial applications due to its high thermal conductivity, light weight, and economy.

The thickness of the heat shield is suitably about 1/16 to ⅛ inches (0.159 to 0.318 cm). Although the heat shield is normally sufficiently thick to substantially support its own weight, the heat shield is supported by the hereinbefore described contiguous association with the insulation material in which it is disposed.

The emissivity of the heat shield is suitably about 0.5 to 1.0 where the emissivity of a "black body" is by definition 1.0. Thus the heat shield of the present invention is essentially a radiation absorber. However, the heat shield of the present invention is essentially a heat conductor, its emissivity being irrelevant to its function.

The heat shield of the present invention is cooled by a conventional two stage or three stage mechanical refrigeration unit located external to the outer shell of the double-walled container. One skilled in the art may also cool the heat shield of the present invention by a single stage mechanical refrigeration unit using an appropriate mixed refrigerant.

Such cooling may be accomplished by having at least one high thermally conductive conduit positioned advantageously between the heat shield and the outer shell contiguously associated with and in heat transfer relationship to the heat shield by a high thermally conductive connection with the shield. Although the conduit may be positioned between the heat shield and the inner shell, one skilled in the art may find such such a positioning disadvantageous from a fabrication viewpoint.

The conduit is conventionally connected so as to be in fluid communication with the mechanical refrigeration unit for circulation of a mechanical refrigeration fluid through the conduit. Thus heat flowing from the ambient adjacent to the outer shell of the container toward the enclosed volume is intercepted by the heat shield which heat is removed from the heat shield by the mechanical refrigeration fluid being circulated through and evaporating in the conduit and ultimately rejected back to the ambient by the mechanical refrigeration unit. Advantageously, the conduit will be constructed in the form of a plurality of coils so positioned in heat-exchanging relationship on portions of the heat shield so as to substantially minimize temperature gradients in the heat shield to less than about 1.0° K. per inch (2.54 cm) and most suitably less than 0.5° K. per inch (2.54 cm).

The conduit may be appropriately constructed from a metal having a thermal conductivity of at least about 0.6 watt/cm° K., for example copper, aluminum or steel. The conduit is joined to the heat shield by, for example, by a suitable adhesive such as a high thermally conductive epoxy, brazing, welding, soldering or in any convenient manner so as to form the high thermally conductive connection. It is apparent to one skilled in the art that conduit spacing depends on the heat shield's thermal conductivity, thickness and the desired shield temperature variation. Advantageously, the heat shield's temperature variation would not exceed about 10° K.

In the practice of the present invention, the high thermally conductive shield advantageously assumes temperature of about 160° K. to 200° K.

State of the art two stage mechanical refrigeration units can develop effective, low cost refrigeration to about 180° K. to 200° K. with 190° K. being a representative practical design parameter. Conventional three stage mechanical refrigeration units can develop effective, low cost refrigeration to about 160° K. to 180° K. with 170° K. being a representative practical design parameter.

Such conventional mechanical refrigeration units are referred to herein as a higher temperature refrigeration source.

It is well known in the art that the temperature attainable by such conventional multistage mechanical refrigeration units is dependent on such factors as the system operating pressure and the pressure drop of the circulated refrigeration fluid which is in turn governed by the length and diameter of the conduit forming the loop through which the refrigeration fluid is circulated.

It will be apparent to one skilled in the art that the high thermally conductive heat shield of the present invention may be of a composite construction having passages internal to the shield for the circulation of the fluid refrigerant by the mechanical refrigeration unit to effect the cooling of the heat shield to temperature about 160° K. to 200° K.

It will be apparent that the temperature assumed by the heat shield of the present invention and the optimum position of the heat shield disposed in the insulation in the evacuable space formed by the inner and outer shells selected in a manner hereinafter more fully described will be governed by the temperature attainable by the multistage mechanical refrigeration unit.

The present invention further comprises a vessel for holding a cryogenic liquid having a boiling point below 90° K. at one standard atmosphere (760 mm Hg), such as liquid nitrogen (77° K.), liquid argon (87° K.) or liquid air (79° K.). The vessel is positioned within the storage container. This liquid is referred to herein as the very low temperature cryogenic liquid refrigerant. The preferred cryogenic liquid refrigerant for use with the present invention is liquid nitrogen because of economy and safety (i.e., nitrogen is nontoxic, nonflammable, nonexplosive and odorless).

The vessel for holding the very low temperature liquid is of an insulated construction so that the temperature of the storage volume can be maintained at temperature higher than temperature of the very low temperature cryogenic liquid refrigerant. This vessel may be constructed with any thermal insulation suitable for cryogenic service. Such thermal insulations include low thermally conductive materials or combinations of low thermally conductive and high radiant reflective materials. Examples of suitable insulations would include those hereinbefore described as suitable for disposition in the evacuable space between the inner and outer shell of the container.

The vessel may be also constructed using a double-walled vacuum insulation construction or a double-walled vacuum insulation construction with an insulation suitable for cryogenic service disposed in vacuum space. Such vessels for holding very low temperature cryogenic liquids are well known in the art.

The construction of the vessel for holding the very low temperature cryogenic liquid refrigerant and the selection of the insulation material employed in a particular application may be determined as follows.

Upon positioning of the vessel for holding the very low temperature liquid refrigerant within the storage container, the volume remaining is referred to herein as the storage volume or storage space. It will be apparent that heat present in the storage volume will flow through the walls of the vessel holding the very low temperature cryogenic liquid, for example liquid nitrogen at 77° K., causing evaporation of the liquid. The vessel is constructed to be in restricted vapor flow communication with the storage volume so that that the evaporated liquid, i.e., vapor, flows from the vessel into the storage volume. This may be conveniently accomplished by fitting the vessel with a removable insulated lid at the top of the vessel which lid is mounted on the vessel in a manner permitting the egress of vapor at the location where the lid seats on the vessel. Removal of this lid would provide access to the vessel for filling with the very low temperature cryogenic liquid. Alternatively, the vessel may be provided with a vent hole which hole would provide for the egress of evaporated cryogenic liquid and for filling the vessel. However, the restricted vapor flow communication between the vessel and the storage volume may be provided for in any manner known to the art.

The thermal insulation for the construction of the vessel is selected so that sufficient heat will flow from the storage area through the insulation causing the evaporation of the very low temperature cryogenic liquid so as to maintain the temperature of the storage volume at a desired temperature intermediate to the temperature of the very low temperature cryogenic liquid refrigeration source and the higher temperature mechanical refrigeration source.

It will be apparent therefore to one skilled in the art that the construction of the vessel will be determined by the amount of heat flowing into the storage volume, the insulation construction chosen to fabricate the vessel, and the very low temperature cryogenic liquid refrigerant which the vessel will hold.

It will be further apparent to one skilled in the art that the amount of heat flowing into the storage volume will be dependent on the amount of heat flowing through the double-walled container and lid. Therefore, the greater amount of heat intercepted by the mechanically cooled heat shield of the present invention and rejected back to ambient the lower will be the heat load imposed on the very low temperature cryogenic liquid refrigerant to maintain the desired intermediate temperature of the storage volume.

The refrigeration storage assembly of the present invention thus adapts itself to design so that coaction of the relatively inexpensive higher temperature mechanical refrigeration source and the relatively expensive very low temperature liquid refrigeration source advantageously achieves the desired intermediated storage temperature in a most cost effective manner. The refrigeration storage assembly of the present invention is advantageously adaptable to achieving storage volume temperatures of about 100° K. to 150° K. and particularly storage volume temperatures of about 130° K. to 150° K.

The design and positioning of the heat shield cooled by the mechanical refrigeration source coacting with the very low temperature liquid refrigeration source can be better understood by comparing temperature gradients of insulated walls with and without heat shields in an idealized situation.

Figure 3:
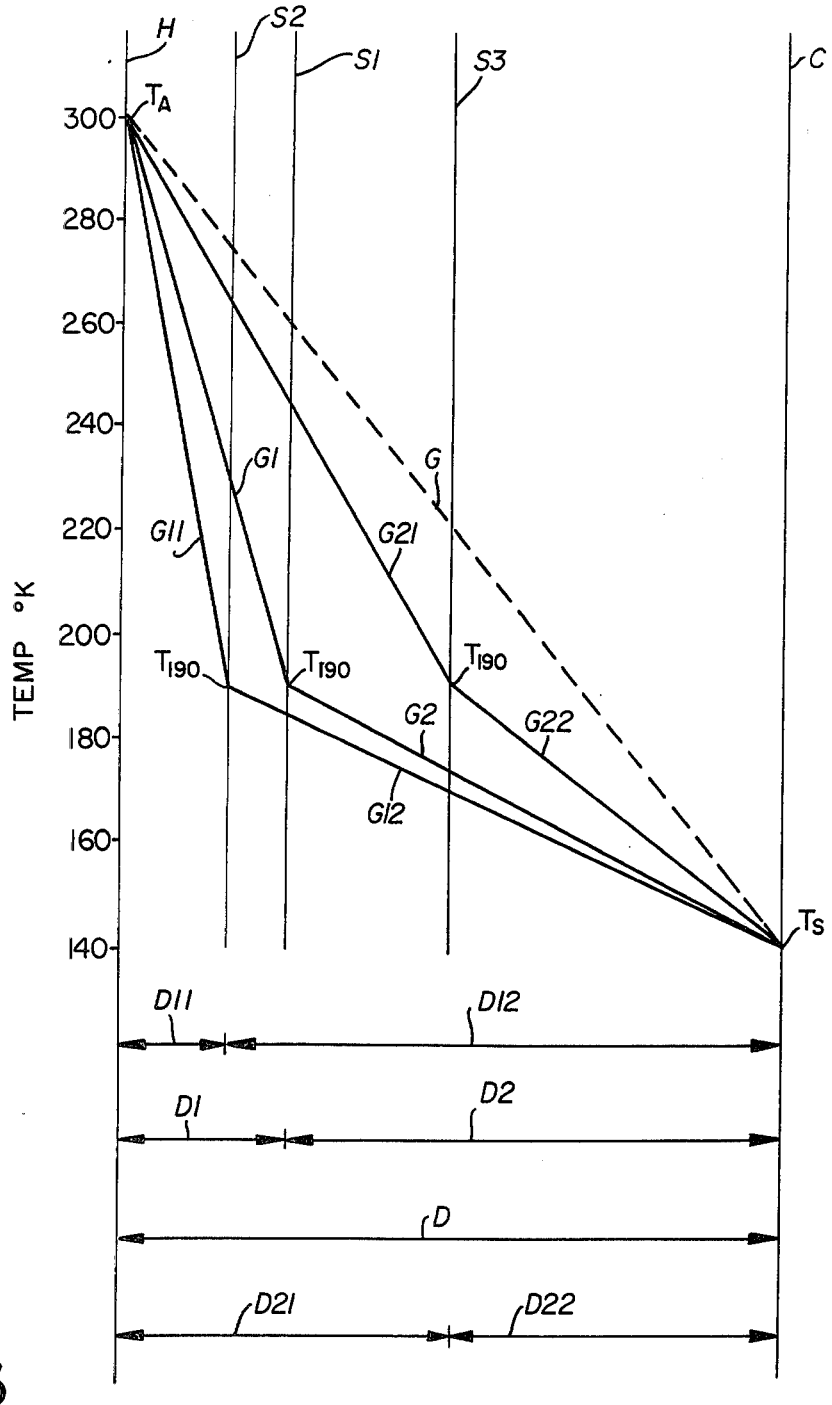
FIG. 3 is a graphical representation of idealized temperature gradients in an insulated wall.

With reference to FIG. 3, representative idealized temperature gradients of insulated walls are graphically plotted based on the formula $$Q = \frac{kA\,(T_2 - T_1)}{X_2 - X_1}\,t$$

where:

Q=the heat flow through a solid material;

k=the thermal conductivity of the material;

A=surface area;

$T_2-T_1$=temperature difference between two points in the material;

$X_2-X_1$=the distance between these two points;

t=time;

and $$\frac{T_2 - T_1}{X_2 - X_1} =$$

the temperature gradient between two points. Thus for a unit area, over a uniform period of time, and a uniform thermal conductivity, the heat flow Q is directly proportional to the temperature gradient.

With reference to the temperature gradient graphs of FIG. 3, H represents the outer shell of a double-walled container adjacent to the ambient and C represents the inner shell of a double-walled container adjacent to the storage volume. For purposes of illustration, the ambient temperature $T_A$ will be considered 300° K. and the storage volume temperature $T_S$ will be considered 140° K. It is understood that the space between the inner and outer shell is filled with thermal insulation (assumed to have a uniform k) and is evacuable as hereinbefore described.

Line G represents the temperature gradient and hence is proportional to the heat flow through the insulated evacuable space of thickness D into the storage volume without the presence of a mechanical refrigerant cooled heat shield.

S1 represents a heat shield which is to be cooled by a mechanical refrigerant in a manner hereinbefore described positioned at a distance D1 from the outer shell, $D_o$, and a distance D2 from the inner shell, Di, where the ratio of $D_o$:Di=1:3. With heat shield S1 cooled to a temperature of 190° K., line G1 represents the temperature gradient and hence is proportional to the heat flow from the outer shell at $T_A$=300° K. to the heat shield S1 at temperature $T_{190}$=190° K. Similarly line G2 represents the temperature gradient and hence is proportional to the heat flow from the heat shield at $T_{190}$=190° K. to the inner shell at $T_S$=140° K. It is apparent that the slope of line G2 is much less than the slope of line G and thus the heat flow into the storage volume with the presence of the heat shield is greatly reduced from the heat flow into the storage volume without the presence of the heat shield.

S2 represents a heat shield similarly cooled positioned at a distance D11 from the outer shell, $D_o$, and a distance D12 from the inner shell, Di, where the ratio of $D_o$:Di=1:5. The heat shield is again cooled to 190° K. ($T_{190}$=190° K.). Considering the temperature gradients, since the slope of line G12 is less than the slope of line G2, the heat flow into the storage volume will be less for a heat shield cooled to 190° K. located at a position $D_o$:Di=1:5 then at position $D_o$:Di=1:3. However, since slope G11 is greater than slope G1, it is also readily apparent to one skilled in the art that a mechanical refrigerant cool heat shield at a temperature of 190° K. positioned at $D_o$:Di=1:5 must have the capacity to remove a greater amount of heat than at position $D_o$:Di=1:3.

Similarly, it can be shown that if the temperature of the heat shield at a selected location is decreased, the amount of heat flowing into the storage volume will be decreased but the amount of heat required to be removed by the heat shield is increased.

S3 represents a heat shield similarly cooled positioned a distance D21 from the outer shell, $D_o$, and a distance D22 from the inner shell, Di, where the ratio $D_o$:Di=1:1. Considering the temperature gradients, it is apparent that the slope of the gradient G22 from shield S3 to the inner wall C is approaching the slope of the gradient G. It will therefore be readily apparent to one skilled in the art, that if the heat shield were positioned so that $D_o$ was greater than Di, there would be little reduction in the heat flow into the storage volume as a result of the use of the mechanical refrigerant cooled shield.

It will also be readily apparent to one skilled in the art, that if the heat shield is located very close to the outer shell H, for example closer than $D_o$:Di=1:10, (not shown) unacceptably large heat loads will be imposed on the mechanical refrigerant system.

It is understood that the foregoing description regarding the effects of the location of the heat shield of the present invention represents an idealized situation considering thermal conductivity through an insulated evacuable wall and is not to be construed as limiting the present invention.

However, it illustrates that as the amount of heat flow removed by the higher temperature mechanical refrigeration source increases and hence places greater demands on the mechanical refrigeration source, the amount of heat required to be removed by the relatively expensive very low temperature cryogenic liquid refrigerant source to maintain the desired intermediate storage volume temperature decreases. Thus the design flexibility of the refrigeration storage assembly of the present invention to utilize the coaction of the higher temperature mechanical refrigeration source and the very low temperature liquid refrigeration source of the present invention to achieve an intermediate storage temperature will be readily apparent to one skilled in the art.

As hereinbefore described, the space between the inner shell and outer shell of the double-walled container is evacuable. In one embodiment of the present invention conventional fittings will be provided in the wall of the container to evacuate this space. A suitable vacuum would be, for example, about 1 micron Hg to 200 micron Hg and the evacuable space would be sealed. This vacuum may be maintained in a conventional manner by the use, for example, of getters.

One skilled in the art may find it advantageous to provide for dynamic vacuum pumping of the evacuable space. In this instance, a vacuum pump would be located external to the double-walled container. One or more conduits with appropriate fittings may provide for fluid communication between the vacuum pump and the evacuable space to provide for either intermittent or continuous vacuum pumping as desired. The use of such dynamic vacuum pumping for the evacuable space would eliminate the need for getters or the like to maintain the vacuum.

The hereinbefore described insulated lid advantageously may also be of double-wall construction providing for an insulation filled evacuable space having appropriate fittings for evacuating and subsequently sealing the evacuable space. One skilled in the art may find it to be of further advantage to provide for dynamic vacuum pumping of the lid for the reason described in the foregoing. In this instance, a flexible conduit that would not interfere with opening and closing of the lid would be furnished with appropriate fittings to provide for fluid communication between the lid evacuable space and the hereinbefore described vacuum pump to effect dynamic vacuum pumping of the lid.

One skilled in the art may also find it advantageous for the hereinbefore described vessel for holding the selected very low temperature liquid to be of evacuable double-walled construction having appropriate conventional fittings in the outer wall wherein the pressure in the evacuable space may be readily varied when desired, for example, by connecting a conventional vacuum pump to the fitting. The vessel may be removed from the enclosed volume of the container to effect such changes in the pressure of the evacuable space.

As the vacuum in the evacuable space of the vessel for holding the very low temperature cryogenic liquid is increased (i.e., the pressure decreased), the amount of heat flow through the walls of the vessel from the storage volume of the container would decrease resulting in decreased removal of heat from the storage volume and decreased evaporation of the very low temperature cryogenic liquid. Decreasing the vacuum in the evacuable space (i.e., increasing the pressure) would increase the amount of heat flow through the walls of the vessel and hence increase the amount of heat removed from the storage volume and increased evaporation of the very low temperature cryogenic liquid. Thus varying the pressure in the evacuable space of the vessel for holding the very low temperature liquid provides a readily adjustable method for varying the temperature of the storage volume of the container.

If desired, it is apparent that means may also be provided for the dynamic vacuum pumping of the evacuable space of the vessel for holding the selected very low temperature liquid. For example, a conduit with appropriate conventional fittings may be provided for fluid communication between the evacuable space of the vessel for holding the very low temperature cryogenic liquid and a vacuum pump located external to the container, thus permitting continuous or intermittent vacuum pumping as desired.

One skilled in the art may also find it advantageous to control the temperature of the storage volume by the use of metallic heat conducting rods penetrating the insulated storage vessel for the very low temperature liquid refrigeration source. This method of temperature control may be practiced as follows:

As hereinbefore described, the vessel for holding the very low temperature liquid refrigeration source is insulated and in restricted vapor flow communication with the storage volume so that the temperature of the storage volume may be maintained at a temperature higher than the temperature of the cryogenic liquid refrigerant. Heat in the storage volume flows through the thermal insulation of the storage vessel causing evaporation of the liquid refrigerant and thus results in lowering the storage volume temperature. If the amount of heat flow from the storage volume to the liquid refrigerant is increased and therefore increasing the evaporation of the liquid refrigerant, the temperature of the storage volume is decreased. A high thermally conductive elongated metal rod with a first end in heat-exchanging relationship with the storage volume and second end in heat-exchanging relationship with the selected liquid refrigerant in the insulated storage vessel would increase the transfer of heat from the storage volume to the liquid refrigerant and thus result in a decrease in the storage volume temperature. It is thus apparent that by selectively inserting or removing one or more such high thermally conductive metal rods through feedthroughs provided in the insulated storage vessel's walls or cover, the temperature of the storage volume may be selectively controlled. Feedthroughs for such metal rods are suitably located in the hereinbefore described cover for the insulated storage vessel. Insulated plugs would be suitably provided for insertion in the feedthroughs in the absence of a rod. Selectively changing the number of rods thus provides a simple and advantageous method of regulating the storage volume temperature.

The high thermally conductive rods would appropriately have a thermal conductivity of at least about 1.4 watts/cm ° K. at 80° K., and would be suitably constructed of, for example, copper or aluminum.

It is apparent that the ends of the rods may have extended surfaces such as fins or the like to improve heat exchange between the storage volume and the liquid reservoir.

In some instances, one skilled in the art may find it advantageous to fabricate the double-walled evacuable insulated vessel for holding the very low temperature cryogenic liquid refrigerant in a manner wherein portions of the outer wall of the vessel for holding the cryogenic liquid refrigerant and the inner shell of the container share a common wall. If such a common wall construction is used, it is also desirable that this common wall be constructed from a high thermally conductive material, such as aluminum or copper, which is in heat transfer relationship with the container storage volume. The high thermally conductive common wall would provide for a portion of the hereinbefore described heat flow from the container storage volume through the insulation of the vessel for holding the cryogenic liquid refrigerant causing removal of heat from the storage volume and the evaporation of the cryogenic liquid refrigerant.

If such a common wall construction was used, passages may be provided in the common wall so that the double-walled evacuable insulated vessel for holding the cryogenic liquid refrigerant and the evacuable double walled storage container share a common vacuum.

EXAMPLE I

Figure 2:
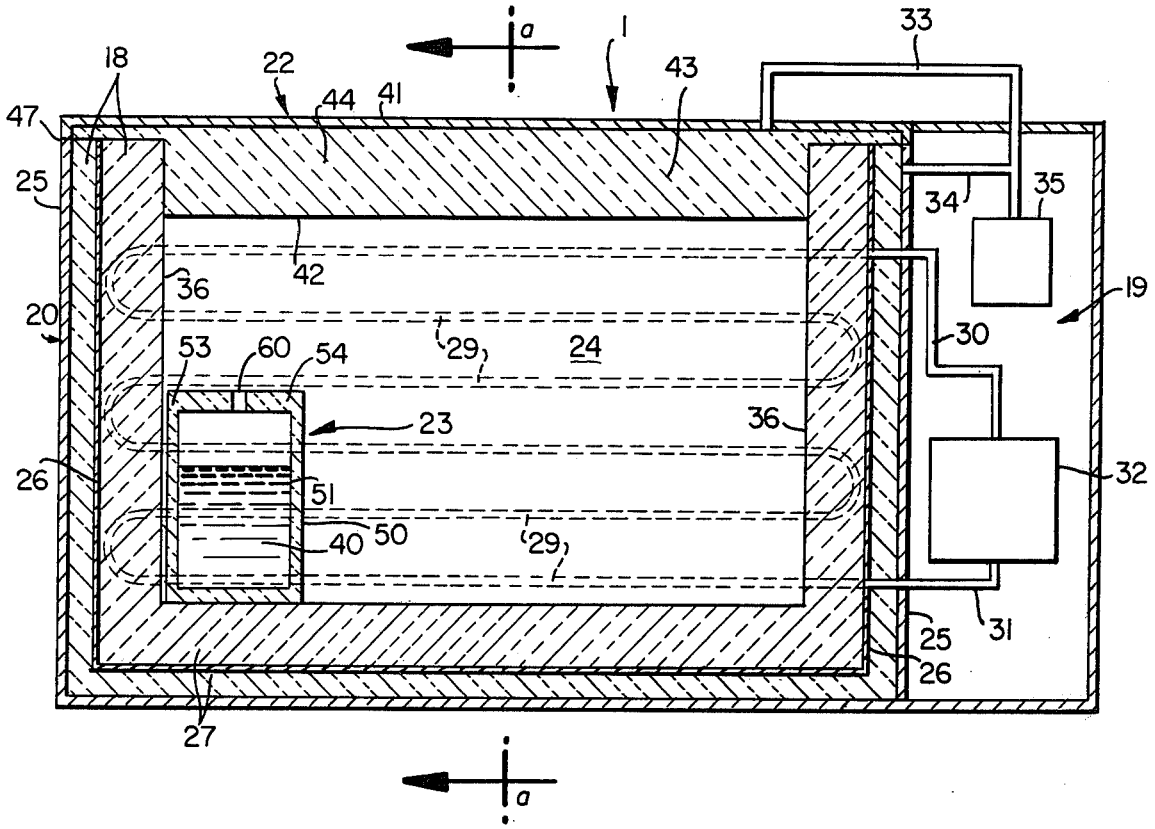
FIG. 2 is a schematic of a particular embodiment of a refrigeration storage assembly in accordance with the present invention as illustrated in FIG. 1.
Figure 2A:
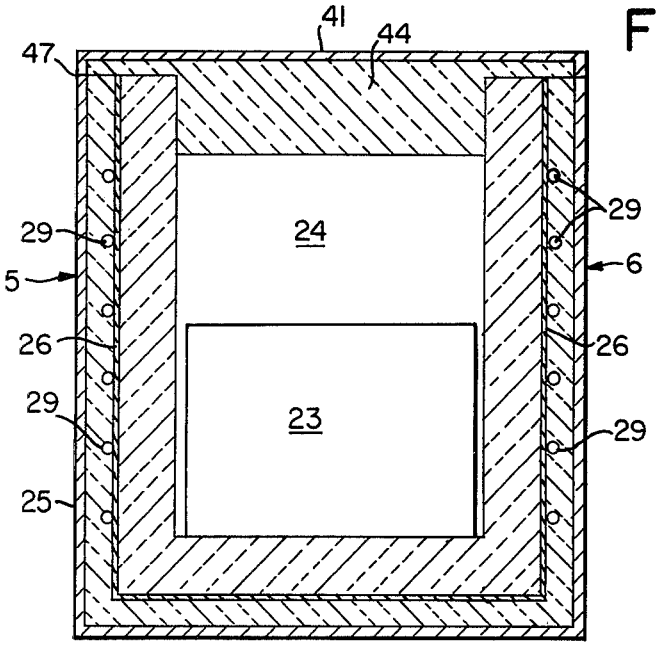
FIG. 2A is a sectional view taken along line a—a of FIG. 2.

With reference to FIG. 1 and FIG. 2, a refrigeration storage assemble was constructed to illustrate a particular embodiment of the present invention.

The refrigeration storage assemble 1 comprises a storage container 20 of double-walled construction forming an enclosed volume 24 having an opening in the top to provide access to the enclosed volume and an adjoining conterminous machinery storage compartment 19. The double-walled container 20 is constructed from an outer shell 25 and an inner shell 36 arranged and constructed with respect to the outer shell 25 to form an evacuable space 18 therebetween. Thermal insulation material 27 is disposed in and substantially fills the evacuable space 18. The insulation material is Johns Mansville No. 4362-60 fiberglass mat material having about 10% phenolic resin binder rigidized to form a 15 lb/cu. ft. (240 kg/cu.m.) fiberglass board having approximately 5% compression at a one atmosphere load. The thermal conductivity of such an insulation is about $115\times10^{-5}$ BTU/hr.ft. ° F. ($2\times10^{-5}$ watt/cm ° K.) at a pressure level of 10 microns ($10\times10^{-6}$ m.) mercury. A heat shield 26 is disposed within the insulation material 27 substantially parallel to and generally coextensive with and transversely spaced from the inner shell 36 and outer shell 25. The heat shield 26 is fabricated from an approximately ⅛ inch (0.318 cm) thick aluminum sheet. The heat shield 26 is positioned about 1 inch (2.54 cm), $D_o$, from the outer shell and about 4 inches (10.2 cm), Di, from the inner shell ($D_o$:Di=1:4).

The double-walled container 20 described in the foregoing has the shape of a rectangular parallelepiped wherein the bottom base and the four side walls are of the double-walled construction having the insulation material 27 and heat shield 26 disposed within the evacuable space 18 therebetween.

Copper tube coils 29 are epoxy bonded (not shown) using Ecco Bond 60-L manufactured by Emerson & Cummings, Canton, Ma. in heat-transferring relationship to the portion of the heat shield 26 disposed in the front wall 5 and rear wall 6 of the double-walled container 20 on the side of the heat shield 26 facing the outer shell 25. Mechanical refrigerant fluid R12 (dichlorodifluoromethane) is circulated through coils 29 via tube 30 and removed by tube 31 by connection to conventional two stage mechanical refrigeration unit 32 positioned in the machinery storage compartment 19. Individual tubes of the tube coil 29 are spaced on the surface of the portion of heat shield 26 disposed in front wall 5 and rear wall 6 in the aforementioned heat-exchanging relationship at approximately six inch (15.2 cm) vertical intervals and extend horizontally substantially the full width of the portion of the heat shield disposed in front wall 5 and rear wall 6. This arrangement minimized temperature gradients in the entire heat shield to about 0.2° K. per inch (2.54 cm). The entire heat shield is maintained at a temperature of about 190° K.±5° K. by this arrangement.

The double-walled container is fitted with a lid 22 which is of double-walled construction having an outer wall 41 and an inner wall 42 arranged and constructed to form an evacuable space 43 therebetween. Thermal insulation material 44 is disposed within and substantially fills the evacuable space 43. In this instance the thermal insulation material 44 comprised an 8 inch (20.3 cm) thickness of Johns Manville No. 4362-60 fiberglass mat having about 10% phenolic resin binder rigidized to form a 15 lb/cu. ft. (240 kg/cu.m.) fiberglass board having approximately 5% compression at one atmosphere load.

Lid 22 is hingedly mounted to double-walled container 20 (not shown) to provide for opening and closing of lid 22 to permit access to the enclosed volume 24.

A vacuum pump 35 is positioned in machinery storage compartment 19 and is in fluid communication with evacuable space 18 of double-walled container 20 through conduit 34 and in fluid communication with evacuable space 43 of lid 22 through conduit 33. Conduit 33 is of flexible construction to permit the opening and closing of lid 22 without interference. Vacuum pump 35 is intermittently operated to maintain the pressure in evacuable space 18 and 43 at less than about 100 microns ($100\times10^{-6}$ m.) mercury.

Positioned within the enclosed volume 24 is a vessel 23 for holding liquid nitrogen 40. The vessel 23 is of double-walled construction having an aluminum inner shell 51 and an aluminum outer shell 50 arranged and constructed with respect to the inner shell 51 to form an evacuable space 54 therebetween. Thermal insulation material 53 is disposed in and substantially fills evacuable space 54. The thermal insulation material is Johns Mansville No. 4362-60 fiberglass mat material having about 10% phenolic resin binder rigidized to form a 15 lb/cu. ft. (240 kg./cu.m.) fiberglass board having approximately 5% compression at one atmosphere load. The width of the evacuable space 54 in which the insulation was disposed is about 1 inch (2.54 cm) for the side walls and bottom wall and about 1½ inch (3.81 cm) for the top wall of vessel 23. A fill/vent hole having a diameter of about ⅜ inch (0.95 cm) is provided in the top wall of vessel 23 to permit restricted vapor flow communication with enclosed volume 24 for the egress of fluid due to the evaporation of the liquid nitrogen from the interior of vessel 23 into enclosed volume 24 and to provide for the filling of vessel 23.

The thermal insulation and the pressure of evacuable space 54 of vessel 23 are selected so that with lid 22 of double-walled container 20 closed and heat shield 26 being maintained at about 190° K. by mechanical refrigeration unit 32, the heat flow from enclosed volume 24 through vessel 23 causing evaporation of liquid nitrogen 40 (77° K.) will be in an amount required to maintain the enclosed volume 24 at a temperature of about 140° K. The pressure maintained in evacuable space 54 of vessel 23 in the herein described embodiment is about 10 to 1000 microns mercury.

When lid 22 of double-walled container 20 is in the closed position, the seal 47 formed by lid 22 and double-walled container 20 is sufficiently porous to permit egress of vapor from the enclosed volume 24 to the ambient.

The double-walled container 20 described in the foregoing has the shape of a rectangular parallelepiped wherein the bottom base and the four side walls are of the double-walled construction described. The upper-base forms the access opening which is fitted with lid 22. The enclosed volume 24, so formed, has a length of about 80 inches (203.2 cm), a width of about 25 inches (63.5 cm) and a height of about 31 inches (78.7 cm) with lid 22 in the closed position. The enclosed volume thus has a gross volume of about 35.9 cubic feet (1.02 cu.m.). The liquid nitrogen storage vessel 23 positioned in the enclosed volume 24 has a volume of about 5.9 cubic feet (0.17 cu.m.). Thus the net volume of the enclosed volume 24 available for storage is about 30 cubic feet (0.85 cu.m.) which is referred to as the storage volume.

EXAMPLE II

A series of tests were conducted to determine the evaporation rates of liquid nitrogen for a refrigeration storage assembly of a particular embodiment of the present invention constructed as described in the foregoing. The heat shield was maintained at about 190° K. and the liquid nitrogen insulated storage vessel was constructed to permit evaporation of liquid nitrogen in an amount sufficient to maintain the enclosed storage volume at a temperature of about 140° K. The ambient temperature was about 300° K. The evacuable space formed by the inner and outer shells of the container and in the container lid were maintained at between 10 and 100 microns mercury by intermittent dynamic pumping. Liquid nitrogen evaporation rates were determined for conditions when the lid remained in the closed position (i.e., the static condition) and for conditions when the lid was opened a selected number of minutes per day. The results of these tests are tabulated in Table I.

TABLE I

| REFRIGERATION STORAGE ASSEMBLY OF PRESENT INVENTION | |
|---|---|
| LID OPENING TIME IN MINUTES/DAY | $LN_2$ EVAPORATION RATE IN LITTERS/DAY |
| 0 (STATIC RATE) | 11.1 |
| 3 | 12.7 |
| 6 | 13.1 |
| 12 | 13.5 |
| 30 | 17 |

Figure 4:
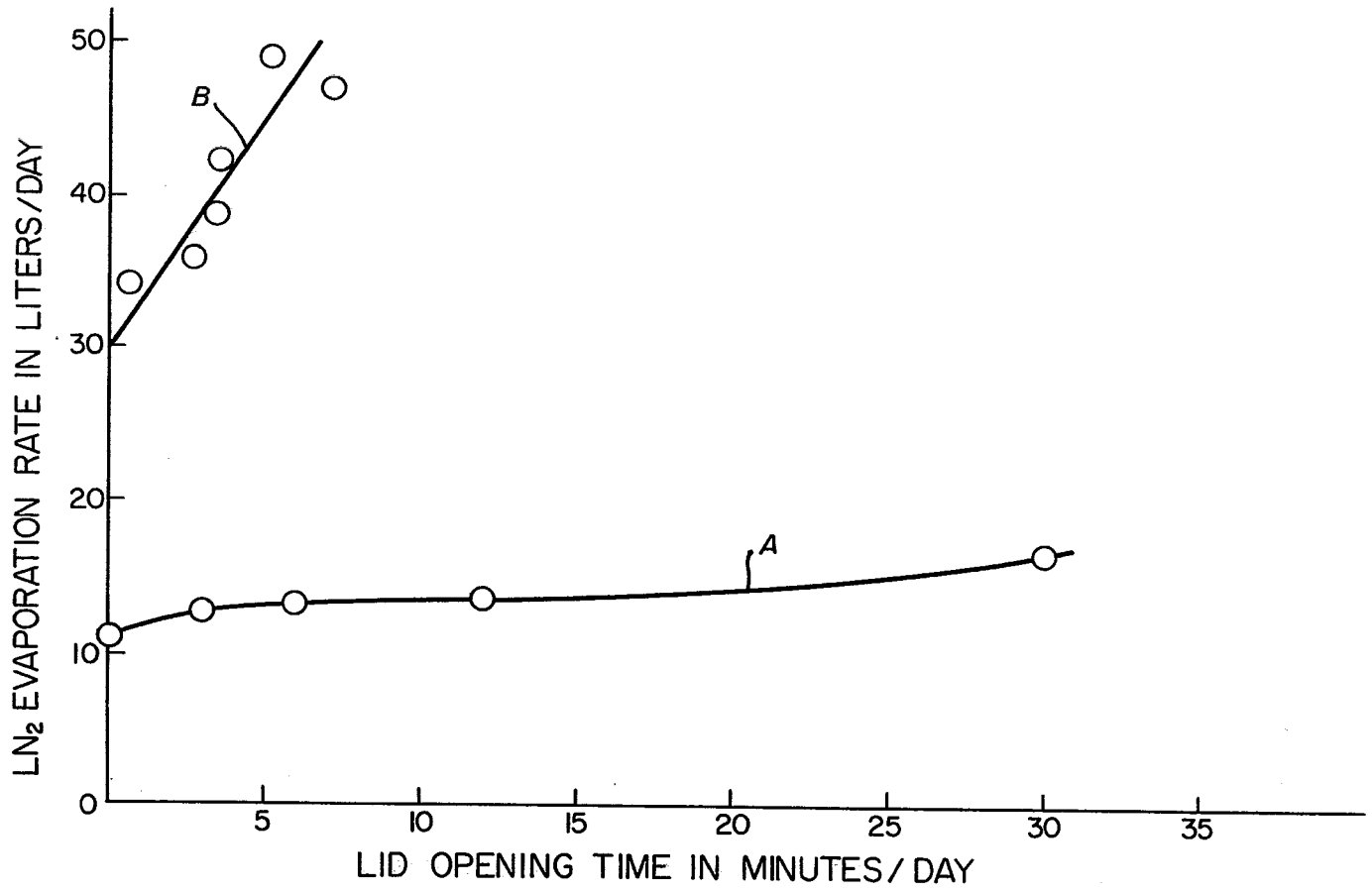
FIG. 4 is a graph showing the improved liquid nitrogen evaporation rates for a refrigeration storage assembly of a particular embodiment of the present invention as illustrated in FIGS. 1 and 2.

These results as tabulated in Table I for the refrigerated storage assembly of the present invention are plotted in curve A in FIG. 4.

A series of tests were also conducted with a state of the art liquid nitrogen refrigerator used to store biological materials. The state of the art liquid nitrogen refrigerator used for the tests was a model LR-1000 manufactured by Union Carbide Corporation, New York, New York. The model LR-1000 refrigeration unit is well known in the art for the storage of biological material and comprises an insulated container having evacuable insulated side walls and having a non-evacuable insulated lid for access to the storage volume. The storage volume has a volume of 28.4 cubic feet. As is known in the art, in the model LR-1000, a liquid nitrogen pool is maintained in the bottom of the storage volume to provide a refrigeration source and the materials to be stored are maintained on a shelf or shelves above the pool. The model LR-1000 does not have a mechanically cooled heat shield positioned in the insulated container walls.

Liquid nitrogen evaporation rates with the ambient temperature being about 300° K. were determined for conditions when the lid remained in the closed position (i.e., the static condition) and for conditions when the lid was opened a selected number of minutes per day. The results of these tests are tabulated in Table II.

TABLE II

| STATE OF THE ART LR-1000 REFRIGERATOR | |
|---|---|
| LID OPENING TIME IN MINUTES/DAY | $LN_2$ EVAPORATION RATE IN LITTERS/DAY |
| 0 (STATIC RATE) | 30 |
| 0.6 | 34.1 |
| 2.6 | 36.0 |
| 3.4 | 39.3 |
| 3.4 | 42.0 |
| 5.1 | 49.1 |
| 7.2 | 47.2 |

These results as tabulated in Table II for the LR-1000 state of the art refrigeration unit for the storage of biological materials are also conventionally plotted in FIG. 4 as curve B.

With reference to Table I and II and FIG. 4, the foregoing tests demonstrate that the refrigeration storage assembly of the present invention wherein a higher temperature mechanical refrigeration source coacts with a very low temperature cryogenic liquid refrigeration source (e.g., liquid nitrogen) to maintain an intermediate low temperature for storage of biological materials significantly reduces the usage of the expensive liquid nitrogen refrigerant in comparison with a state of the art refrigerator using a liquid nitrogen refrigerant source for the storage of biological materials. For example, the static evaporation rate for liquid nitrogen (i.e., the lid remains closed) for a refrigeration storage assembly of a particular embodiment of the present invention is 11.1 liters/day whereas the static evaporation rate for liquid nitrogen in the state of the art refrigerator is 30 liters/day.

More significantly, a commercial or research laboratory requires, in many instances, daily access to the refrigerated container for removal or insertion of biological materials which are stored. The foregoing tests demonstrate that the coaction of the higher temperature mechanical refrigeration source and very low temperature cryogenic liquid refrigeration source (e.g., liquid nitrogen) in the refrigeration storage assembly of a particular embodiment of the present invention markedly reduces expensive liquid nitrogen evaporate rates in comparison to a state of the art liquid nitrogen refrigerator under operating conditions which require periodic opening of the container lid for access to the container. Furthermore, the curves of FIG. 4 demonstrate that the liquid nitrogen evaporation rate for a state of the art liquid nitrogen refrigeration unit (curve B) increase rapidly with small increases in the increment of time during which the lid is open. In contrast, FIG. 4 demonstrates that the evaporation rate of expensive liquid nitrogen in the refrigeration storage assembly of a particular embodiment of the present invention (curve A) does not exhibit a significant sensitivity to small increases in the increment of time during which the lid is open. Furthermore, FIG. 4 demonstrates that the user of a refrigeration storage assembly of a particular embodiment of the present invention (curve A) is afforded a reasonable amount of access time per day to the storage container without significantly increasing the evaporation of expensive liquid nitrogen.

EXAMPLE III

Additional tests were conducted in which the temperature of the storage volume was measured at the bottom of the storage volume and at selected distances in the vertical direction from the bottom of the storage volume in order to determine a temperature profile for the refrigerated storage assembly of a particular embodiment of the present invention. These results are tabulated in Table III. Similar temperature measurements were made for the LR-1000 state of the art container starting at the liquid nitrogen level in the bottom of the container. These results are tabulated in Table IV.

TABLE III

| TEMPERATURE PROFILE REFRIGERATION STORAGE ASSEMBLY OF PRESENT INVENTION | |
|---|---|
| DISTANCE FROM BOTTOM IN INCHES | TEMPERATURE °K. |
| 0 | 139 |
| 15.5 (39.4 cm) | 141 |
| 24 (61.0 cm) | 141 |
| 31 (78.7 cm) | 157 |

TABLE IV

| TEMPERATURE PROFILE STATE OF THE ART LR-1000 REFRIGERATOR | |
|---|---|
| DISTANCE FROM BOTTOM IN INCHES | TEMPERATURE °K. |
| 4 (10.2 cm) | 78 |
| 14 (35.6 cm) | 120 |
| 20 (50.8 cm) | 135 |
| 26 (66.0 cm) | 147 |
| 31 (78.7 cm) | 157 |

Figure 5:
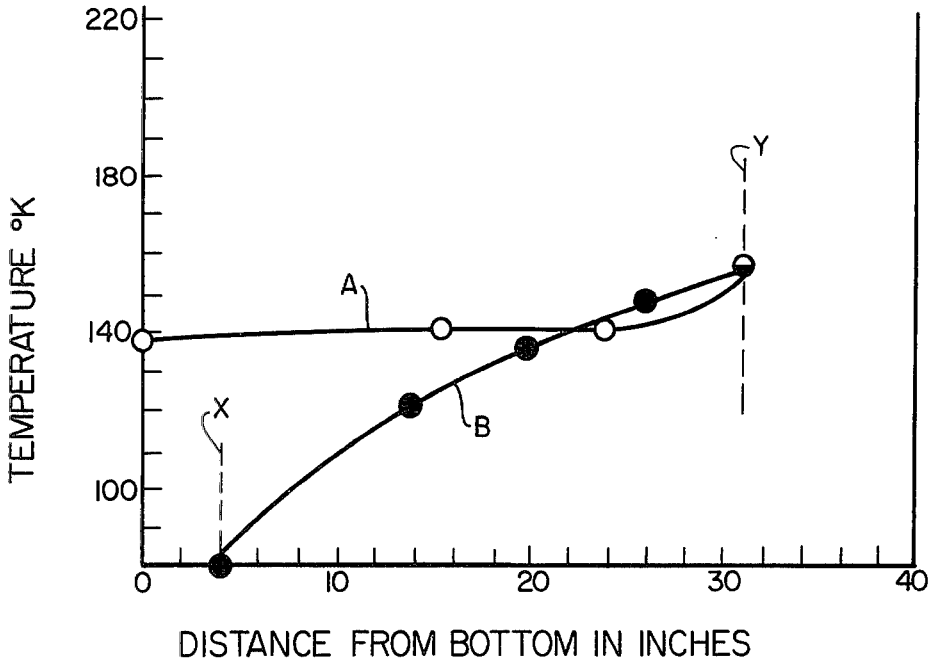
FIG. 5 is a graph showing the improved temperature profile for the storage volume of a refrigeration storage assembly of a particular embodiment of the present invention as illustrated in FIGS. 1 and 2.

The results tabulated in Tables III and IV are plotted in FIG. 5 wherein curve A is a plot of the values of Table III representing the temperature profile of the storage volume of the refrigeration storage assembly of a particular embodiment of the present invention; curve B is a plot of the values of Table IV representing the temperature profile of a LR-1000 state of the art liquid nitrogen refrigeration unit; dashed-line X represents the liquid nitrogen level (about 4 inches) in the bottom of a LR-1000 state of the art liquid nitrogen refrigeration unit; and dashed-line Y represents the location of the lid in place (about 31 inches from the bottom of the storage volume) for both units.

With reference to Tables III and IV and FIG. 5, the foregoing tests demonstrate that the storage volume of the refrigeration storage assembly of a particular embodiment of the present invention exhibits a very constant temperature profile. In contrast, the storage volume of the state of the art LR-1000 refrigerator exhibits a significant temperature gradient proceeding from the bottom to the top of the storage volume with resulting undesirable refrigerator operating costs since the mean temperature of the storage volume of state of the art liquid nitrogen refrigeration unit would be significantly below a desired storage temperature—e.g., a temperature less than about 150° K.

EXAMPLE IV

In order to further demonstrate the operating cost efficiencies of a refrigeration storage assembly in accordance with the present invention, calculations were performed to illustrate the relative cost of removing heat flowing from an ambient termperature of 540° R. (300° K.) through a square foot (929 sq cm.) of surface area of a wall of a hypothetical container into the storage volume maintained at 252° R. (140° K.) wherein the lid of the container is assumed to remain closed. The calculations were performed for a container using only a liquid nitrogen refrigeration source to maintain the storage volume temperature and for a refrigeration storage assembly of the present invention wherein coaction of a higher temperature mechanical refrigeration source and a very low temperature liquid refrigeration source—i.e., liquid nitrogen—maintain the intermediate storage volume temperature. Using typical October 1979 costs for liquid nitrogen, mechanical refrigerant and electricity, the basis and results of these comparative calculations are listed in Table V.

TABLE V

BASIS

Insulation Thickness - 5 inches (12.7 cm.)
Insulation Thermal Conductivity - $140 \times 10^{-5}$ BTU ft/hr. ft$^2$ °R ($2.4 \times 10^{-5}$ watt/cm°K.)
Ambient Temperature - 540° R(300° K.)
Storage Volume Temperature - 252° R (140° K.)

RESULTS

| | Conventional Container | Refrigeration Storage Assembly of Present Invention |
|---|---|---|
| Shield Location from Wall Adjacent Ambient | None | 1 inch (2.54 cm) |
| Shield Temperature | 482° R* (267.8° K.) | 432° R (190° K.) |
| Storage Volume Influx BTU/hr. ft$^2$ | 0.97 | 0.38 |
| Relative System Operating Cost/FT$^2$ | 1 | 0.47 |
| Cost Reduction | — | 53% |

*Insulation temperature 1 inch (2.54 cm) from wall.

The foregoing calculations thus further illustrate the efficiency of a refrigeration storage assembly in accordance with the present invention in comparison with a refrigerated container of the prior art.

It is to be noted that the refrigeration storage assembly of the present invention offers an additional advantage to the refrigeration user in that if either refrigeration source malfunctions, one refrigeration source would still be operative thus affording a longer time period for repair or transfer of the stored articles to another refrigeration unit before spoilage of the stored materials commenced.

It is contemplated that modifications may be made within the spirit and scope of the present invention.

What is claimed is:

1. A refrigeration storage assembly comprising:

(A) a storage container comprising:

(i) an inner shell forming an enclosed volume having means for providing access to said enclosed volume;

(ii) an outer shell substantially coextensive with and spaced from said inner shell arranged and constructed with respect to said inner shell so as to form a first evacuable space therebetween;

(iii) insulation material disposed within said first evacuable space;

(iv) a highly thermally conductive shield disposed in said insulation material generally coextensive with and transversely spaced from said inner shell and said outer shell wherein the ratio of the distance from said shield to said outer shell $D_0$ to the distance from said shield to said inner shell Di is from about 1:10 to 1:1;

(B) means for cooling said shield to temperature about 160° K. to 200° K. including:

(i) mechanical refrigeration means external to said storage container (A);

(C) a vessel located within said storage container (A) for holding a cryogenic liquid having a boiling point below 90° K. at one standard atmosphere being arranged and constructed for restricted vapor flow communication with the inner shell enclosed volume (A)(i);

(D) means for evaporating cryogenic liquid in said vessel (C) to form vapor for flow into said inner shell enclosed volume (A)(i) in an amount sufficient to maintain the temperature of said inner shell enclosed volume (A)(i) intermediate to the temperature of said cryogenic liquid and the temperature of said shield (A)(iv).

2. A refrigeration storage assembly as recited in claim 1 wherein said intermediate temperature of (D) is about 100° K. to 150° K.

3. A refrigeration storage assembly as recited in claim 1 wherein said intermediate temperature of (D) is about 130° K. to 150° K.

4. A refrigeration storage assembly as recited in claim 1 wherein said means (D) comprises a selected insulation construction for said vessel (C).

5. A container as recited in claim 4 wherein said means (D) further comprises at least one high thermally conductive elongated member having a first end and a second end said elongated member penetrating said vessel (C) for holding said cryogenic liquid so that said first end is in heat-exchanging relationship with said cryogenic liquid and said second end is in heat-exchanging relationship with said inner shell enclosed volume (A)(i).

6. A refrigeration storage assembly as recited in claim 1 wherein said cooling means (B) further includes at least one high thermally conductive conduit positioned between said shield (A)(iv) and said outer shell (A)(ii) joined by a high thermally conductive connection with said shield (A)(iv) and in fluid communication with said mechanical refrigeration means (B)(i) for passage of a fluid refrigerant through said conduit.

7. A refrigeration storage assembly as recited in claim 1 wherein said access means of (A)(i) includes an insulated lid.

8. A refrigeration storage assembly as recited in claim 7 wherein said lid comprises a double wall construction having a second evacuable space therebetween and insulation material disposed within said second evacuable space.

9. A refrigeration storage assembly as recited in claim 8 which further comprises means for dynamic vacuum pumping said first and said second evacuable space.

10. A refrigeration storage assembly as recited in claim 1 wherein said ratio of (A)(iv) is from about 1:5 to 1:3.

11. A refrigeration storage assembly as recited in claim 1 wherein said shield (A)(iv) is located about ½ to 2 inches from said outer shell (A)(ii).

12. A refrigeration storage assembly as recited in claim 1 wherein said shield (A)(iv) is located about 1 inch from said outer shell (A)(ii).

13. A refrigeration storage assembly as recited in claim 1 wherein said cryogenic liquid of (C) is nitrogen.

14. A refrigeration storage assembly as recited in claim 1 wherein said mechanical refrigeration means (B)(i) is a two stage mechanical refrigeration unit and said shield (A)(iv) assumes temperature of about 180° K. to 200° K.

15. A refrigeration storage assembly as recited in claim 1 wherein said mechanical refrigeration means (B)(i) is a three stage mechanical refrigeration unit and said shield (A)(iv) assumes temperature of about 160° K. to 180° K.

16. A refrigeration storage assembly as recited in claim 1 which further comprises means for dynamic vacuum pumping said first evacuable space of (A)(ii).

17. A refrigeration storage assembly as recited in claim 1 wherein said means (D) comprises vessel (C) having a double wall construction forming a third evacuable space therebetween.

18. A container as recited in claim 17 wherein said means (D) includes means for varying the pressure in said third evacuable space.

19. A refrigeration storage assembly comprising:

(A) a storage container comprising:

(i) an inner shell forming an enclosed volume having an opening for access to said enclosed volume;

(ii) an outer shell substantially coextensive with and spaced from said inner shell arranged and constructed with respect to said inner shell so as to form a first evacuable space therebetween;

(iii) insulation material disposed within said first evacuable space;

(iv) a removable lid in said opening of (A)(i) said lid comprising a double walled construction having a second evacuable space therebetween;

(v) insulation material disposed within said second evacuable space;

(vi) a high termally conductive shield disposed in said insulation material within said first evacuable space generally coextensive with and transversely spaced from said inner shell and said outer shell wherein the ratio of the distance from said shield to said outer shell $D_o$ to the distance from said shield to said inner shell Di is about 1:5 to 1:3 and wherein $D_o$ is about ½ to 2 inches;

(vii) at least one high thermally conductive conduit positioned between said shield and said outer shell joined by a high thermally conductive connection with said shield;

(B) mechanical refrigeration means external to said storage container (A) in fluid communication with said conduit (A)(vii) for passage of a fluid refrigerant through said conduit to maintain said shield (A)(vi) at temperature of about 160° K. to 200° K;

(C) vacuum pump means external to said storage container (A) for dynamically pumping said first and second evacuable space to maintain pressure therein at less than about 100 microns mercury;

(D) an insulated vessel located within said storage container (A) for holding a cryogenic liquid having a boiling point below 90° K. at one standard atmosphere, said vessel being arranged and constructed for restricted vapor flow communication with said inner shell enclosed volume (A)(i) and to evaporate said cryogenic liquid to form vapor for flow into said inner shell enclosed volume (A)(i) in an amount sufficient to maintain temperature of said inner shell enclosed volume (A)(i) at about 100° K. to 150° K.

* * * * *

UNITED STATES PATENT AND TRADEMARK OFFICE

CERTIFICATE OF CORRECTION

PATENT NO. : 4,300,356

DATED : November 17, 1981

INVENTOR(S) : Frank Notaro et al

It is certified that error appears in the above—identified patent and that said Letters Patent is hereby corrected as shown below:

Column 4, line 38, after "watt/cm°K" insert

-- at 190°K. --

Signed and Sealed this

*Fifteenth* Day of *June 1982*

[SEAL]

*Attest:*

GERALD J. MOSSINGHOFF

*Attesting Officer*

*Commissioner of Patents and Trademarks*